United States Patent [19]

Kishi

[11] Patent Number: 4,466,509

[45] Date of Patent: Aug. 21, 1984

[54] ELEVATING DEVICE

[76] Inventor: Mitsuhiro Kishi, 1320 Mizuhonocho, Ashikaga-shi, Tochigi-Pref., 326-03, Japan

[21] Appl. No.: 359,541

[22] Filed: Mar. 18, 1982

[30] Foreign Application Priority Data

| | | | |
|---|---|---|---|
| Mar. 20, 1981 | [JP] | Japan | 56-41289 |
| Jun. 27, 1981 | [JP] | Japan | 56-99947 |
| Jun. 27, 1981 | [JP] | Japan | 56-99948 |
| Aug. 26, 1981 | [JP] | Japan | 56-134487 |

[51] Int. Cl.[3] ..... B66B 11/04

[52] U.S. Cl. ..... 187/18; 182/141

[58] Field of Search ..... 187/18, 8.71; 254/122, 254/2 R, 2 C, 6 R, 95, 97, DIG. 6; 182/63, 141, 69, 157, 158, 223

[56] References Cited

U.S. PATENT DOCUMENTS

| | | | |
|---|---|---|---|
| 3,003,746 | 10/1961 | Gridley | 187/18 |
| 3,820,631 | 6/1974 | King et al. | 182/141 |
| 4,375,248 | 3/1983 | Kishi | 187/18 |

*Primary Examiner*—Joseph J. Rolla
*Assistant Examiner*—Kenneth Noland
*Attorney, Agent, or Firm*—Martin A. Farber

[57] ABSTRACT

An elevating apparatus installed on a mobile body such as a crawler-type vehicle or truck comprises at least a pair of middle supporting beams pivotably coupled together by a pivot and unfoldable into an X shape, and two pairs of lower and upper supporting beams slidably supported in the pair of middle supporting beams. The lower and upper supporting beams can be pushed out of and retracted into the middle supporting beams by a hydraulic mechanism for lifting and lowering a lift or platform mounted on the upper supporting beams.

14 Claims, 20 Drawing Figures

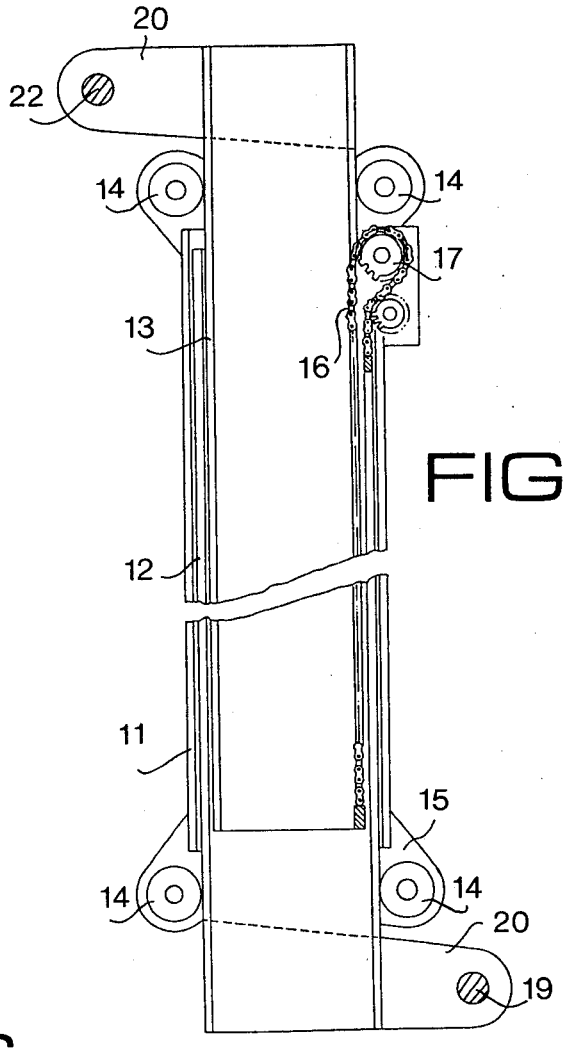
FIG.15
FIG.16
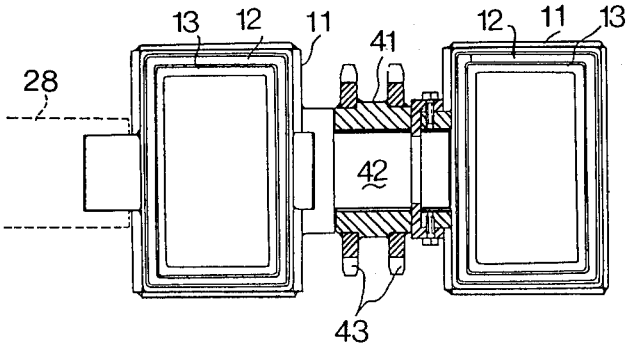

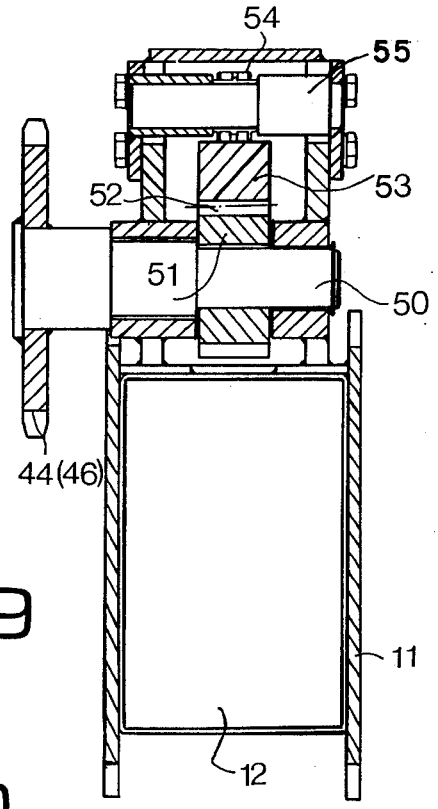
FIG.19
FIG.20
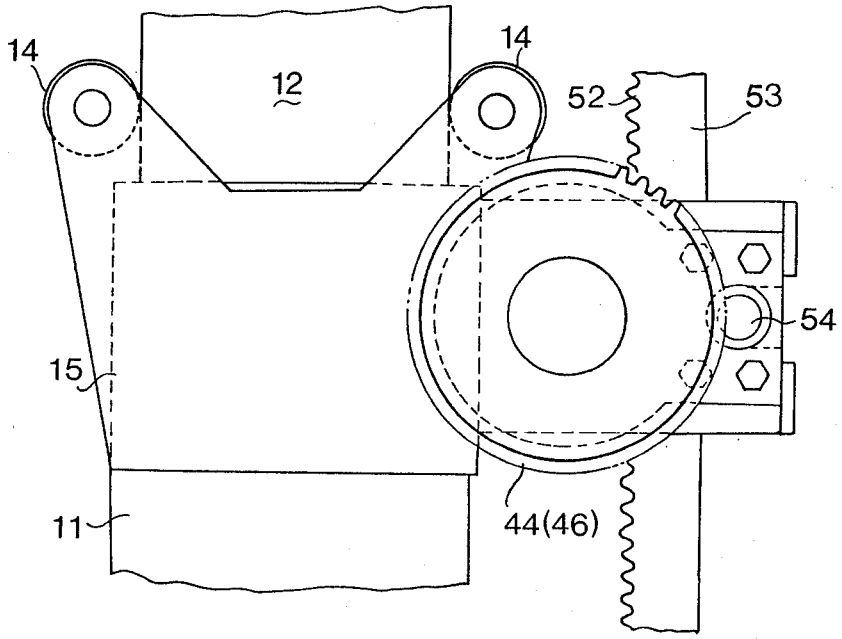

ELEVATING DEVICE

BACKGROUND OF THE INVENTION

The present invention relates to an elevating apparatus mounted on a mobile vehicle such as a truck or a crawler-type vehicle for elevating workers and/or materials at construction sites, for example.

There have heretofore been known elevating apparatus for lifting and lowering workers, materials and/or tools at various places for construction, painting, repair or other types of work. One prior type of elevating apparatus includes pairs of arms pivotably interconnected at their middle portions to provide a foldable or collapsable X-shaped or pantograph assembly.

It has been customary practice to provide an elevating mechanism capable of reaching a higher location by coupling a plurality of such X-shaped or pantograph assemblies as a vertically extensible structure. The interconnected elevating mechanism, however, is complicated in construction and unstable in operation. It is also disadvantageous in that the platform cannot be lowered to a level near a ground surface and tends to be wobbly at a lifted level.

SUMMARY OF THE INVENTION

It is an object of the present invention to provide an elevating apparatus capable of keeping a lift easily and stably at a sufficiently high controlled level above ground.

Another object of the present invention is to provide an elevating apparatus capable of lowering a lift down to a level near a ground surface.

According to the present invention, an elevating apparatus for being mounted on a mobile body such as a crawler-type vehicle or truck comprises a pair of telescopic supporting beam assemblies composed of at least a pair of middle supporting beams pivotally coupled to each other by a pivot shaft and unfoldable into an X shape, and two pairs of lower and upper supporting beams telescopically supported in the pair of middle supporting beams. The lower and upper supporting beams can be pushed out of and retracted into the middle supporting beams by a hydraulic mechanism for lifting and lowering a lift or platform mounted on the upper supporting beams. The lower and upper supporting beams are interconnected by lift chains trained around sprocket wheels rotatably mounted in the middle supporting beams. The hydraulic mechanism comprises a pair of hydraulic cylinder assemblies mounted on the mobile body and connected to the pivot shaft. Alternatively, the hydraulic mechanism includes a hydraulic cylinder assembly disposed in the lower and middle supporting beams and having a cylinder connected to the lower supporting beam and a piston member coupled to the middle supporting beam. The elevating apparatus further includes an initial lifting device for enabling the telescopic supporting beam assemblies to be lifted at an initial stage of lifting operation, and a synchromechanism for keeping the lift horizontal while being elevated.

With the above and other objects and advantages in view, the present invention will become more clearly understood in connection with the detailed description of preferred embodiments, when considered with the accompanying drawings, of which:

BRIEF DESCRIPTION OF THE DRAWINGS

FIG. 15 is a fragmentary longitudinal cross-sectional view of a telescopic supporting beam assembly in the elevating apparatus shown in FIG. 11;

FIG. 16 is a transverse cross-sectional view of the supporting beam assembly of FIG. 14;

FIG. 19 is a cross-section of a part of the supporting beam assembly indicated at one end thereof;

FIG. 20 is a side elevational view of an end of the telescopic supporting beam assembly in the elevating apparatus shown in FIG. 19.

DESCRIPTION OF THE PREFERRED EMBODIMENTS

Figure 1:
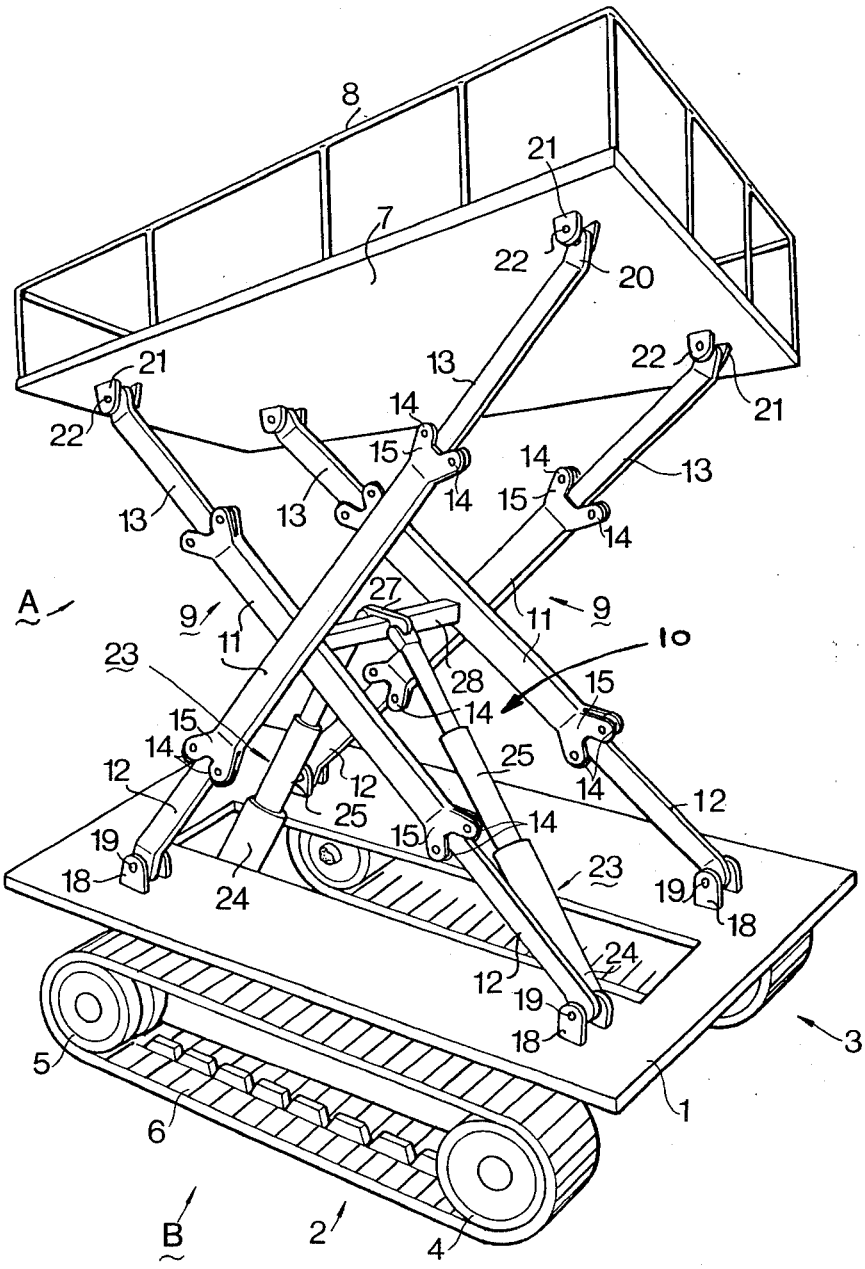
FIG. 1 is a perspective view of an elevating apparatus according to an embodiment of the present invention.
Figure 2:
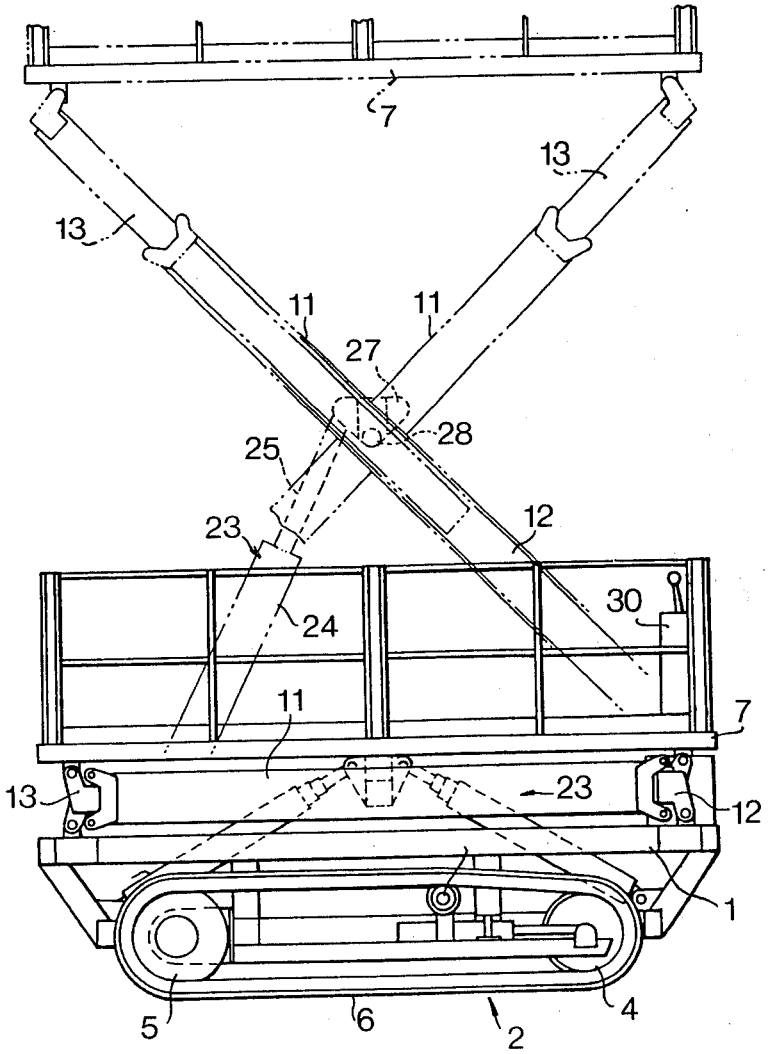
FIG. 2 is a side elevational view of the elevating apparatus shown in FIG. 1.

FIGS. 1 through 4 show an elevating apparatus A according to an embodiment of the present invention.

The elevating apparatus A is mounted on a crawler-type vehicle B. The crawler-type vehicle B includes a vehicle body 1 in the form of a flat plate, and a pair of individually controllable crawlers 2, 3, supporting thereon the vehicle body 1. Each of the crawlers 2, 3 is composed of a driving sprocket wheel 4, an idling sprocket wheel 5, and an endless crawling belt 6 trained around the sprocket wheels 4, 5.

The elevating apparatus A comprises a lift or platform 7 having guard rails 8, a pair of telescopic supporting beam assemblies 9.

Figure 4:
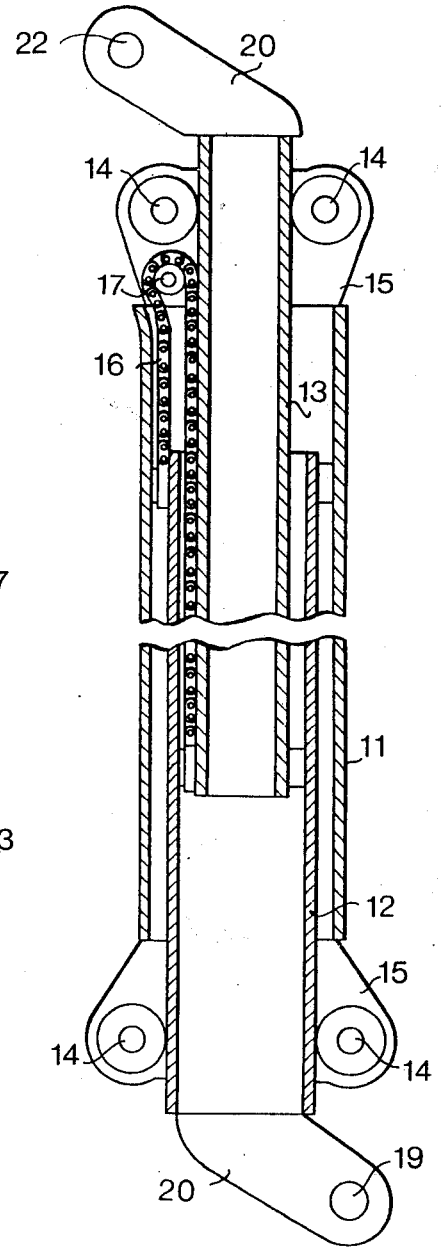
FIG. 4 is a fragmentary longitudinal cross-sectional view of a telescopic supporting beam assembly in the elevating apparatus.

Each of the pair of telescopic supporting beam assemblies 9 is basically composed of a pair of middle supporting beams of a hollow tubular construction 11 pivotably coupled at their intermediate portions to each other and angularly movable into an X shape, a pair of lower supporting beams 12 slidably supported in the hollow tubular beams 11 and extending out of lower ends thereof, and a pair of upper supporting beams 13 slidably supported in the hollow tubular beams 11 and extending out of upper ends thereof. The hollow tubular beams 11 have upper and low end flanges 15 supporting thereon a plurality of guide rollers 14 sandwiching the upper and lower supporting beams 12, 13. As illustrated in FIG. 4, each hollow tubular beam 11 accommodates therein a lift chain 16 having one end fixed to the lower supporting beam 12 and the other end to the upper supporting beam 13. The upper end flange 15 supports thereon a sprocket wheel 17 around which the lift chain 16 is trained in a substantially folded U-shaped configuration.

As shown in FIG. 1, a plurality of support blocks 18 are fixedly mounted on the vehicle body 1. Each of the lower supporting beams 12 has a lower bracket 20 pivotably supported by a pin 19 on one of the support blocks 18. Likewise, the lift 7 has a plurality of support blocks 21 fixedly mounted on its underside. Each of the upper supporting beams 13 has a upper bracket 20 pivotably mounted by a pin 22 on one of the support blocks 21.

The lift controller 10 comprises a pair of hydraulic cylinder assemblies 23 each having a cylinder 24 pivotably mounted on the vehicle body 1 below the support blocks 18, a telescopic piston member 25 movable in a direction out of the cylinder 24 in response to a hydraulic pressure buildup in the cylinder 24, and a hydraulic pressure generator 26 (FIG. 3) mounted on the vehicle body 1 therebelow and composed of an engine, a hydraulic pump and other parts for supplying an equal hydraulic pressure to the cylinders 24. Each of the piston members 25 has an upper end pivotably coupled to a support member 27 on a crossbeam 28 having opposite ends rotatably connected to the middle supporting beams 11 where they are pivotably joined to each other in each telescopic supporting beam assemblies 9.

The lift controller 10 further includes hydraulic motors 29 (FIG. 3) drivable by the hydraulic pressure generator 26 for independently rotating the sprocket wheels 4 in the respective crawlers 2, 3.

Figure 3:
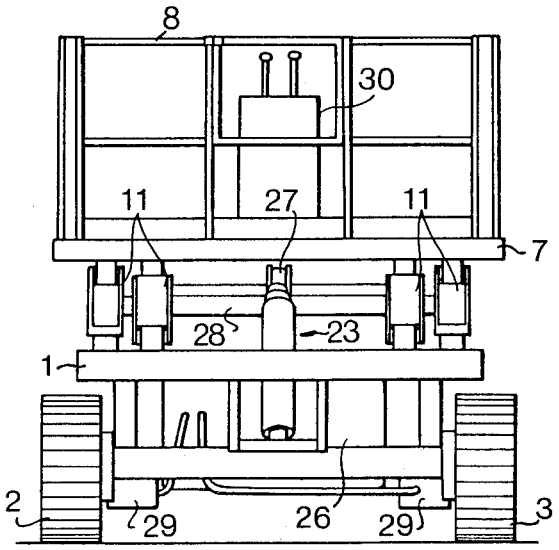
FIG. 3 is a front elevational view of the elevating apparatus shown in FIG. 1.
Figure 5:
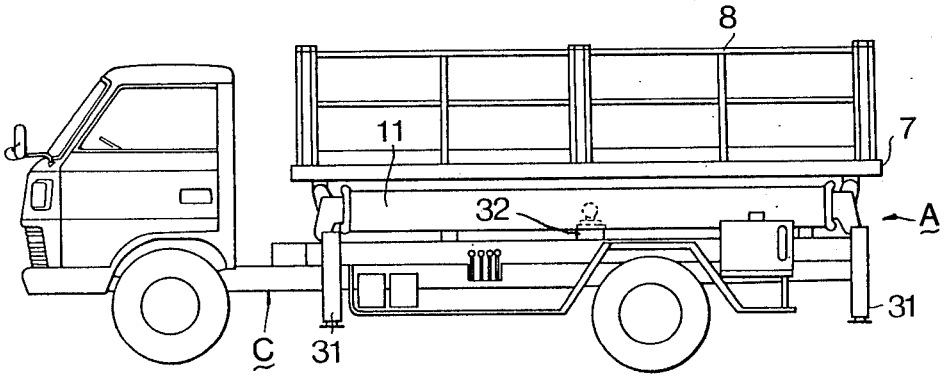
FIG. 5 is a side elevational view of an elevating apparatus according to another embodiment of the present invention.

As illustrated in FIG. 3, the elevating apparatus A also includes a manual control mechanism 30 mounted on the lift 7 for actuating and inactivating the hydraulic motors 29, and controlling the supply of a hydraulic pressure from the hydraulic pressure generator 26 to cylinder assemblies 23.

Operation of the elevating apparatus A is as follows:

The operator on the lift 7 manipulates the manual control mechanism 30 to enable the lift controller 10 to lift and lower the lift 7. More specifically, when a hydraulic pressure is supplied from hydraulic pressure generator 26 into the cylinder assemblies 23, the telescopic piston members 25 are pushed in a direction out of the cylinders 24, respectively, to raise the crossbeam 28 and hence the middle supporting beams 11 and the upper supporting beams 13 are caused by the lift chains 16 to move upwardly out of the lower and middle supporting beams 12, 11. At this time, the lift 7 is elevated for an interval twice the distance that the crossbeam 28 is lifted.

Since an equal amount of hydraulic pressure is applied to the cylinder assemblies 23, the lift 7 can be elevated while being maintained horizontally stably without unwanted wobbling movement.

When pressurization in the pistons 24 is removed, the telescopic piston members 25 are gradually retracted back into the corresponding cylinders 24 under the load of the lift 7, the supporting beam assemblies 9, the operator, and workers and/or building materials on the lift, which are imposed on the cylinder assemblies 23.

FIGS. 5 through 10 illustrate an elevating apparatus A according to another embodiment of the present invention. The elevating apparatus A is installed on a truck C having a plurality of trestles 31 vertically elongatable under the control of hydraulic pressure supplied thereto. The elevating apparatus A includes two pairs of telescopic supporting beam assemblies 9, each pair being composed of a pair of middle supporting beams 11 pivotably coupled together by a pivot, a pair of lower supporting beams 12 slidably supported in the middle supporting beams 11 and having lower ends pivotably mounted on the truck A, and a pair of upper supporting beams 13 slidably supported in the middle supporting beams 11 and having upper ends pivotably mounted on a lift or platform 7.

Figure 9:
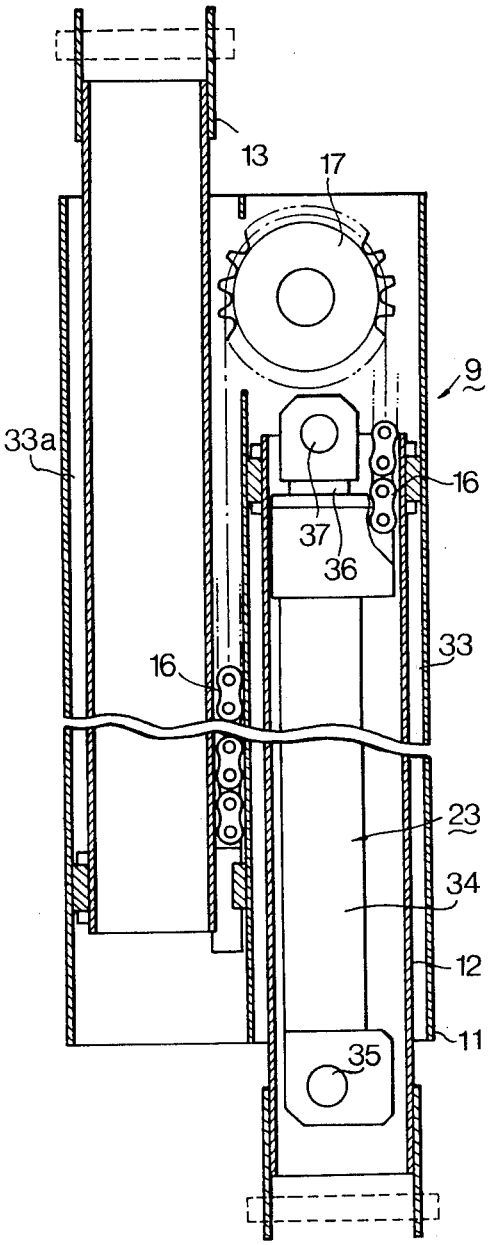
FIG. 9 is a fragmentary longitudinal cross-sectional view of a telescopic supporting beam assembly in the elevating apparatus shown in FIG. 5.

As shown in FIG. 9, each of the middle supporting beams 11 has a pair of parallel hollow guide portions 33, 33*a* in which the lower and upper supporting beams 12, 13 are telescopically fitted, respectively. A cylinder assembly 23 is substantially disposed in the lower and middle supporting beams 12, 11 and has a cylinder 34 having one end 35 fixed to an inner wall surface of the lower supporting beam 12 and a piston member 36 telescopically fitted in the cylinder 34 and having a projecting end 37 fixed to an inner wall surface of the middle supporting beam 11.

An endless chain 16 is trained around a sprocket wheel 17 rotatably mounted in the middle supporting beam 11 and has one end secured to an upper end of the lower supporting beam 12 and the other end to a lower end of the upper supporting beam 13.

Figure 6:
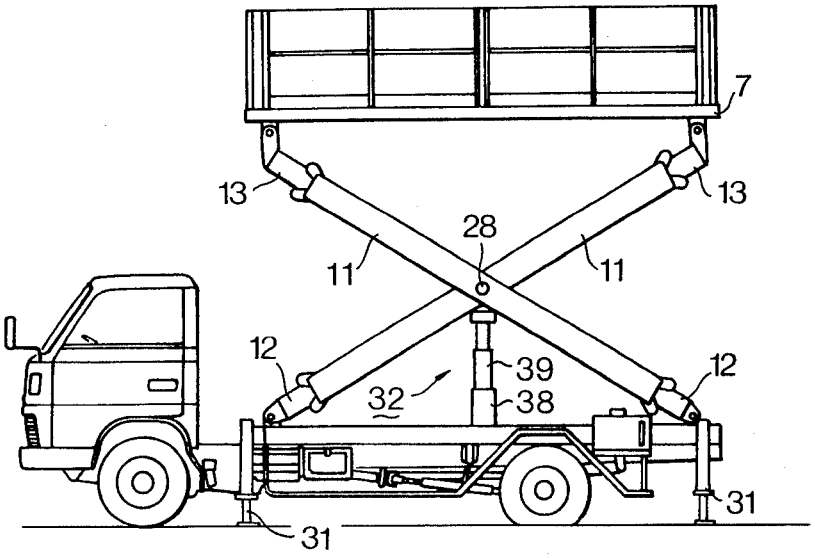
FIG. 6 is a side elevational view of the elevating apparatus of FIG. 5, showing a lift raised to a first stage.
Figure 7:
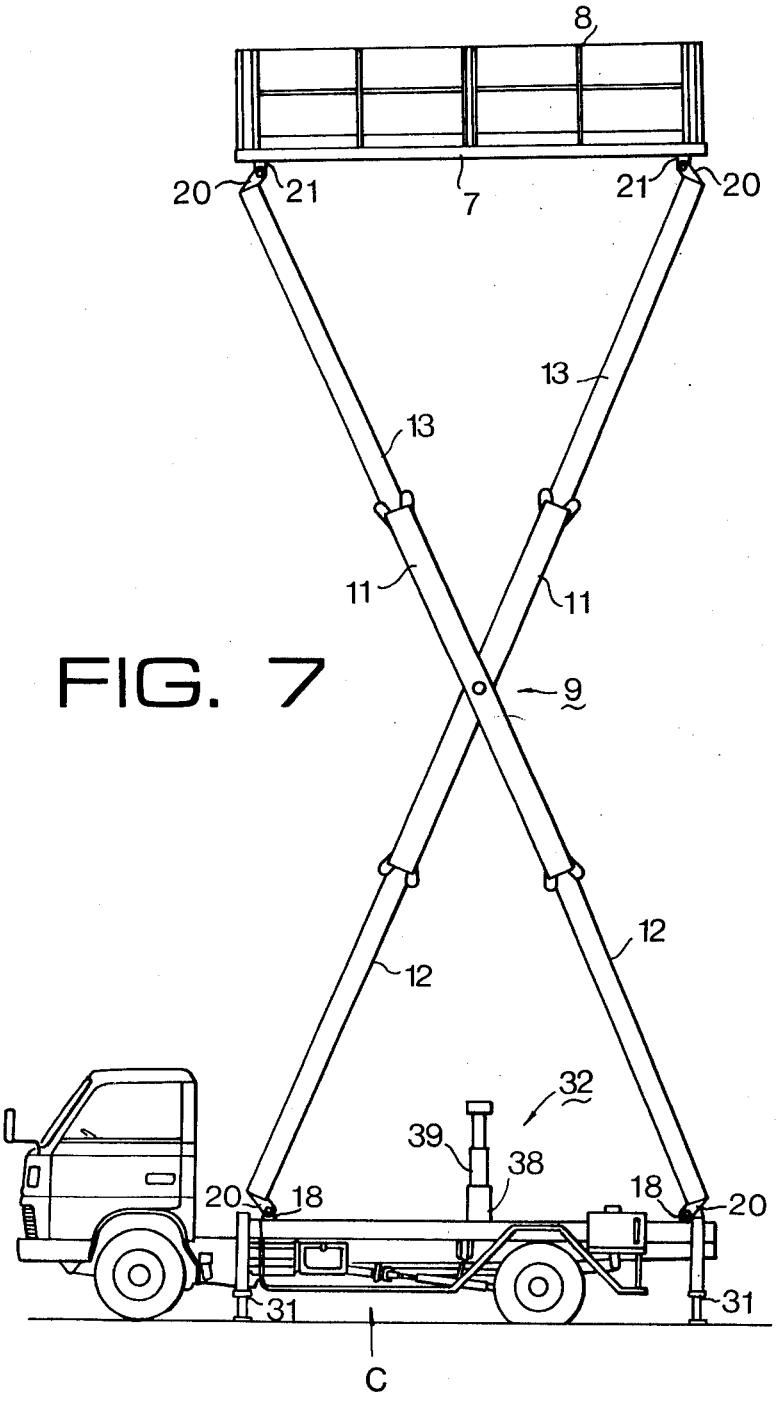
FIG. 7 is a side elevational view of the elevating apparatus of FIG. 5, showing a lift raised to a second stage.
Figure 8:
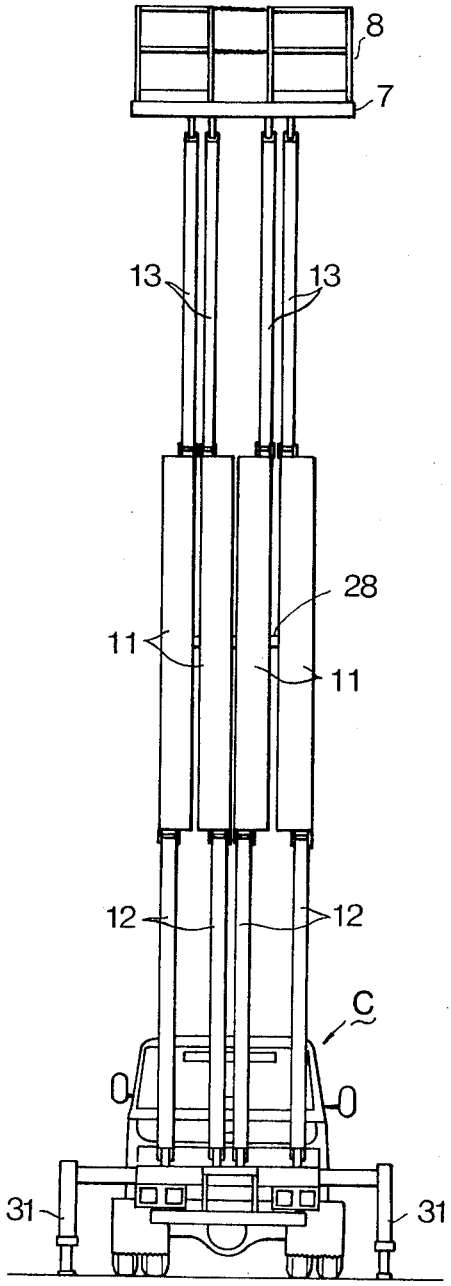
FIG. 8 is a rear elevational view of the elevating apparatus shown in FIG. 7.

As shown in FIGS. 6 and 7, the initial lifting device 32 is mounted on the truck C and includes a hydraulic cylinder 38 and a telescopic piston member 39 movable out of the cylinder 38 in response to hydraulic pressure supplied into the cylinder 38, the piston member 39 being located below a crossbeam 28 when the middle supporting beams 11 are pivotably joined to each other.

Figure 10:
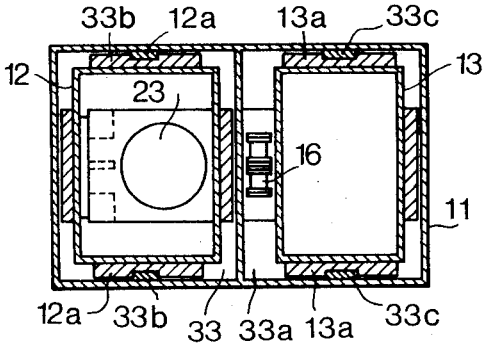
FIG. 10 is a transverse cross-sectional view of the supporting beam assembly of FIG. 9.
Figure 11:
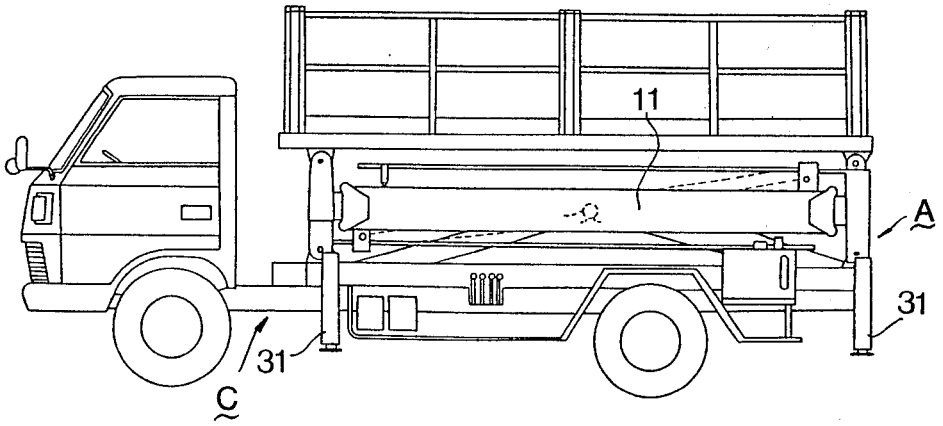
FIG. 11 is a side elevational view of an elevating apparatus according to still another embodiment of the present invention.
Figure 12:
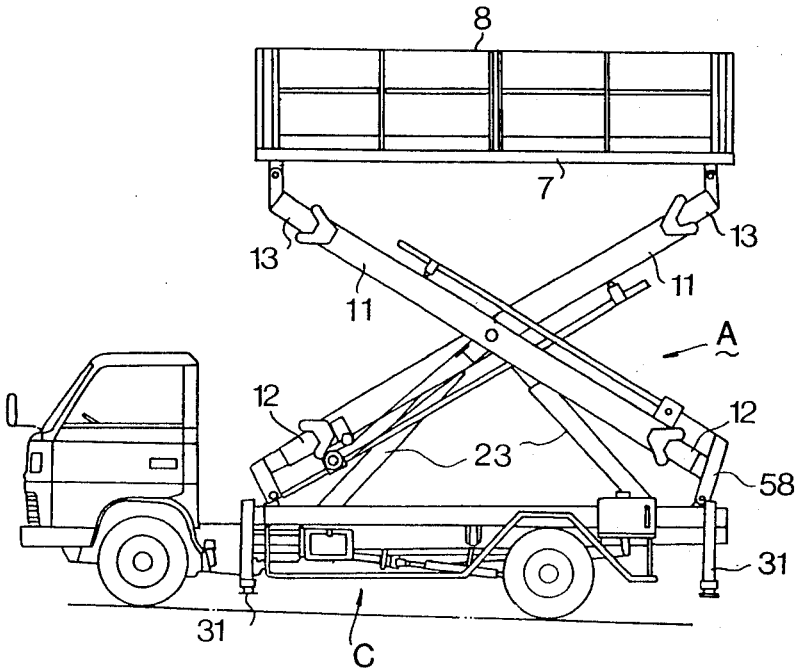
FIG. 12 is a side elevational view of the elevating apparatus of FIG. 11, illustrating a lift elevated up to a first stage.

As illustrated in FIG. 10, each of the guide portions 33, 33*a* of the middle supporting beam 11 has a pair of opposite guide rails 33*b*, 33*c* on inner wall surfaces thereof. Each of the lower and upper beams 12, 13 has on opposite side walls thereof a pair of guide plates 12*a*, 13*a* having longitudinal guide slots in which the guide rails 33*b*, 33*c* are slidably fitted.

The other components shown in FIGS. 5 through 9 are substantially the same as the correspondingly referenced components shown in FIGS. 1 through 4, and will not be described in detail.

In operation, when a hydraulic pressure is supplied into the initial lifting device 32, the telescopic piston member 39 is moved upwardly to lift the crossbeam 28 up to a first stage.

Then, an equal hydraulic pressure is fed into the cylinder assemblies 23 to push the piston members 36 out of the cylinders 34 for thereby shifting the middle supporting beams 11 upwardly and hence pushing the upper supporting beams 13 upwardly through the chains 16. The upper supporting beams 13 are moved upwardly to a second stage as shown in FIG. 7 such that the lift 7 will be elevated for an interval twice the distance of upward movement of the middle supporting beams 11. When the cylinder assemblies 23 and the initial lifting device 32 are released of hydraulic pressurization, the piston members 36 are withdrawn down into the cylinders 34 to allow the telescopic supporting beam assemblies 9 to be folded or collapsed, and the piston member 39 of the initial lifting device 32 is retracted by gravity back into the cylinder 38.

The initial bitting device 32 serves to prevent the beams 11, 12, 13 as they are collapsed in a horizontal position from blocking operation of the cylinder assemblies 23 when the elevating apparatus A is to be actuated to elevate the lift 7.

According to still another embodiment illustrated in FIGS. 11 through 20, an elevating apparatus A is also installed on a truck C having a plurality of vertically actuatable trestles 31.

The elevating apparatus A includes two pairs of telescopic supporting beam assemblies 9 and is similar in construction to the elevating apparatus A of FIGS. 1 through 4 except for a synchromechanism described below.

The synchromechanism serves to balance the lift during vertical movement thereof, and includes, as shown in FIGS. 16 through 20, a collar 41 rotatably supported on a pivot shaft 42 by which adjacent middle supporting beams 11 are pivotably interconnected, a pair of parallel sprocket wheels 43 fixedly mounted on the collar 41, a pair of sprocket wheels 44, 46 rotatably mounted on lower ends of the middle supporting beams 11, and a pair of endless chains 45, 47 trained around the sprocket wheels 43, 44 and the sprocket wheels 43, 46, respectively. The endless chains 45, 47 are tensioned by tensioning pulleys 48, 49, respectively, rotatably mounted on the middle supporting beams 11, respectively.

As shown in FIG. 19, the synchromechanism also comprises a pair of pinions 51 mounted coaxially on shafts 50 on which the sprockets 44, 46 are supported, and a pair of rack members 53 extending substantially parallel to the middle supporting beams 11, and having racks 52 held in mesh with the pinions 51, respectively, and pivotably connected to lower ends of the lower supporting beams 12. Bearing rollers 54 are rotatably mounted on shafts 55 mounted on the lower ends of the middle supporting beams 11. The bearing rollers 54 are held in rolling engagement with upper end portions of the rack members 53 for keeping the racks 52 reliably in mesh with the pinions 51.

Figure 13:
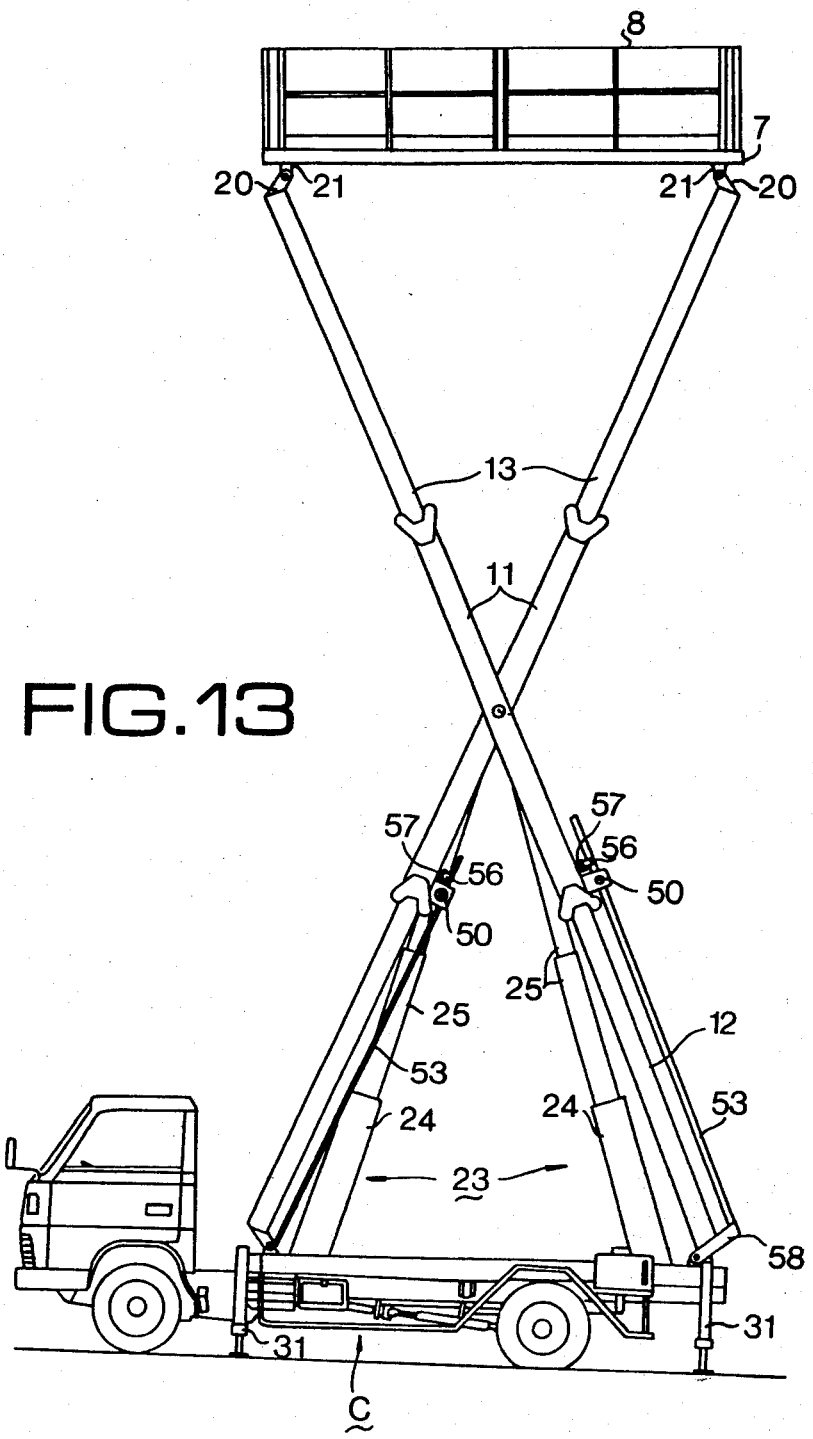
FIG. 13 is a side elevational view of the elevating apparatus of FIG. 11, illustrating a lift elevated up to a second stage.
Figure 14:
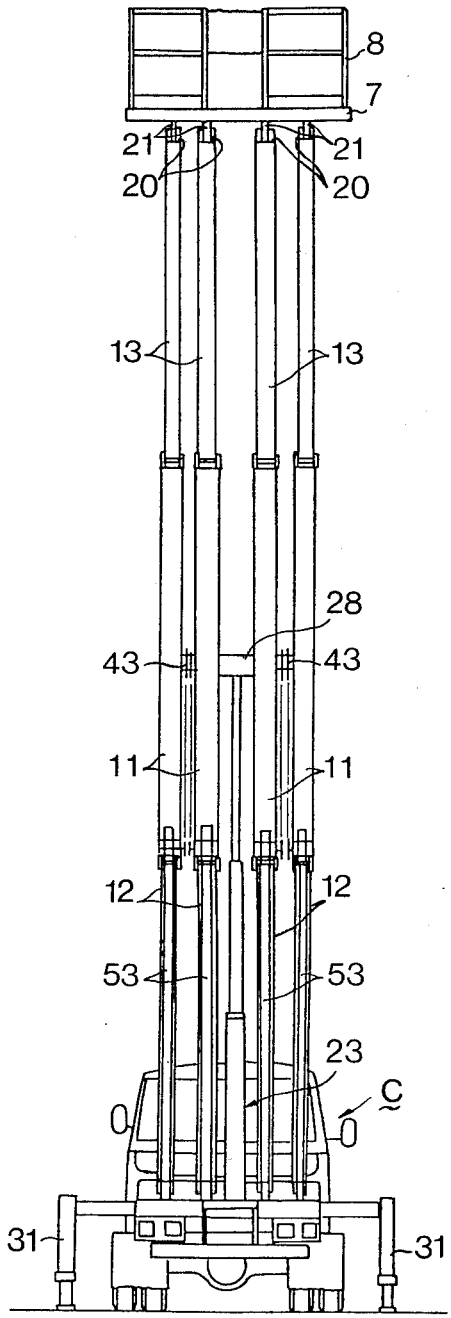
FIG. 14 is a rear elevational view of the elevating apparatus shown in FIG. 13.
Figure 17:
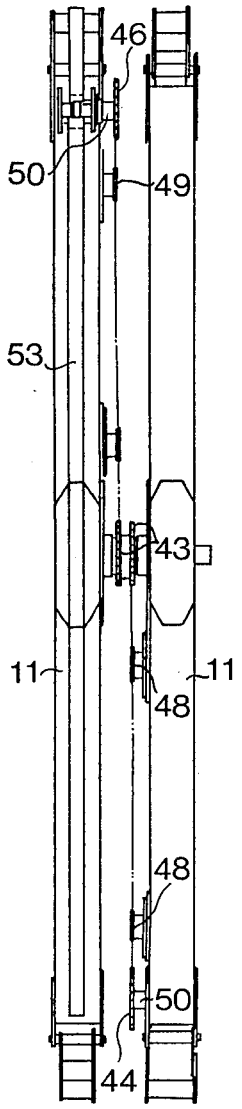
FIG. 17 is a rear elevational view of the telescopic supporting beam assembly shown in FIG. 15.
Figure 18:
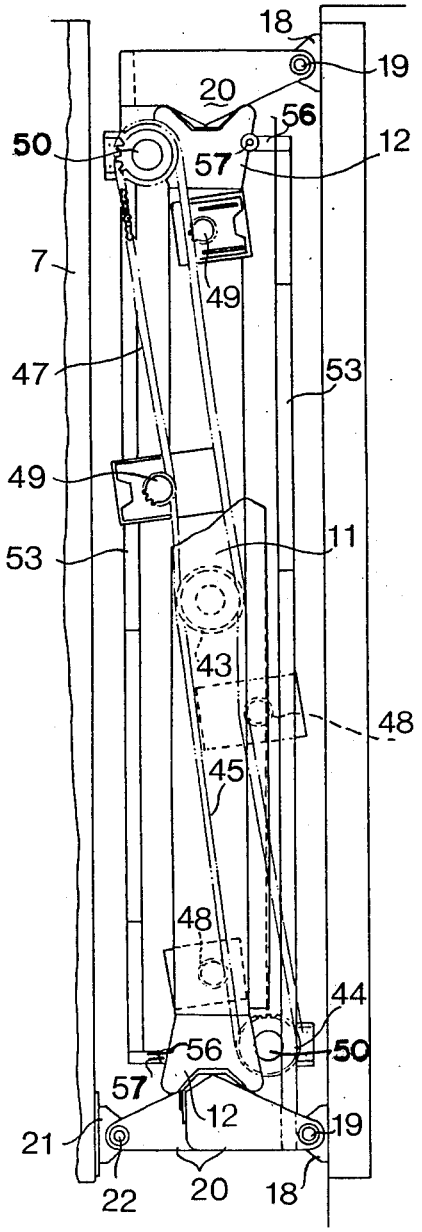
FIG. 18 is a side elevational view of the telescopic supporting beam assembly shown in FIG. 15.

As shown in FIGS. 13 and 18, the rack members 53 have on the upper end portions thereof respective support members 56 including rollers 57 held in rolling contact with lower end surfaces of the middle supporting beams 11. The rack members 53 also have on lower ends thereof pivot members 58 pivotably supported on the lower supporting beam 12.

In operation, when the piston members 25 are pushed out of the respective cylinders 24 in response to a hydraulic pressure supplied to the cylinder assemblies 23, the lower supporting beam 12 are pushed relatively out of the middle supporting beams 11, and at the same time the upper supporting beams 13 are also pushed out of the middle supporting beams 11. Simultaneously, the rack members 53 rotate the pinions 51 to cause the sprocket wheels 44, 46 and the chains 45, 47 to transmit rotative power to rotate the sprocket wheels 43. Since the sprocket wheels 43 do not rotate with respect to each other, the chains 45, 47, the sprocket wheels 44, 46, and the rack members 53 force the lower supporting beams 12 to be pushed relatively out of the middle supporting beams 11 for an equal interval. Accordingly, the lift 7 is maintained horizontally while being moved upwardly.

The lift 7 can be lowered by releasing the cylinder assemblies 23 of the supplied hydraulic pressure.

In the foregoing embodiments, the lift chains 16 and the sprocket wheels 17 may be replaced with another mechanism for moving the lower and upper supporting beams 12, 13 in opposite direction in response to operation of the associated cylinder assemblies.

While I have disclosed one embodiment of the invention, it is to be understood that this embodiment is given by example only and not in a limiting sense.

What is claimed is:

1. An elevating apparatus comprising a vehicle body, a lift, at least one supporting beam assembly for moving said lift up and down on said vehicle body, said supporting beam assembly including a pair of middle supporting beams having a common pivot in a manner to be angularly movable into an X-shape, a pair of lower supporting beams slidably supported in said middle supporting beams, respectively, and a pair of upper supporting beams slidably supported in said middle supporting beams, respectively, means for cooperating with said lower and upper supporting beams to drive the lower and upper supporting beams in opposite directions, means for controlling operation of said at least one supporting beam assembly to move said lift up and down, said cooperating means comprising a chain having one end connected to an upper end of each of said lower supporting beam and an opposite end connected to a lower end of each of said upper supporting beams, and a sprocket wheel rotatably mounted on each of said middle supporting beams, said chain being trained around said sprocket wheel in a substantially folded configuration.

2. The elevating apparatus according to claim 1, wherein said chain is contained substantially within each said middle supporting beam, including a pair of end flanges mounted respectively on ends of said middle supporting beam, said sprocket wheel being positioned on one of said end flanges.

3. The elevating apparatus according to claim 2, including a pair of guide rollers rotatably mounted on each of said end flanges and spaced from each other, said lower and upper supporting beams being movably sandwiched between the pairs of said guide rollers, respectively, for axially aligned telescopic movement in and out of said middle supporting beam.

4. The elevating apparatus according to claim 1, wherein said upper supporting beams are telescopically disposed in said middle supporting beams, respectively.

5. The elevating apparatus according to claim 1, including a pair of fluid pressure cylinder assemblies having cylinders, respectively, pivotably mounted at spaced locations on said vehicle body and pistons telescopically disposed in said cylinders, respectively, and having ends pivotably mounted on said common pivot.

6. An elevating apparatus comprising a vehicle body, a lift, at least one supporting beam assembly for moving said lift up and down on said vehicle body, said supporting beam assembly including a pair of middle supporting beams having a common pivot in a manner to be angularly movable into an X-shape, a pair of lower supporting beams slidably supported in said middle supporting beams, respectively, and a pair of upper supporting beams slidably supported in said middle supporting beams, respectively, means for cooperating with said lower and upper supporting beams to drive the lower and upper supporting beams in opposite directions, means for controlling operation of said at least one supporting beam assembly to move said lift up and down, a synchromechanism for balancing said lift during vertical movement thereof, said synchromechanism including a pair of first sprocket wheels corotatably mounted on said common pivot of said middle supporting beams, a pair of second sprocket wheels rotatably mounted on lower ends of said middle supporting beams, respectively, a pair of endless chains trained around said first and second sprocket wheels, a pair of pinions coaxially secured to said second sprocket wheels, respectively, and a pair of rack members extending substantially parallel to said middle supporting beams, in mesh with said pinions, respectively, and pivotably connected to lower ends of said lower supporting beams, respectively.

7. The elevating apparatus according to claim 6, wherein said common pivot comprises a pivot shaft attached to one of said middle supporting beams and a collar member rotatably fitted over said pivot shaft, said first sprocket wheels being secured to said collar member in coaxial parallel relation to each other.

8. The elevating apparatus according to claim 6, including a pair of tension pulleys rotatably mounted respectively on said middle supporting beams and held in meshing engagement with said endless chains, respectively, for stretching said endless chains under tension.

9. The elevating apparatus according to claim 6, wherein said second sprocket wheels have a pair of shafts rotatably mounted respectively on said middle supporting beams, said pinions being secured to said shafts, respectively.

10. The elevating apparatus according to claim 9, including rack beams extending parallel to said middle supporting beams, said rack members being disposed on said rack beams, respectively, and a pair of bearing rollers rotatably supported on said lower ends of said middle supporting beams, respectively, and held in rolling contact with said rack beams for maintaining said rack members in intermeshing engagement with said pinions, respectively.

11. An elevating apparatus comprising a mobile body, a platform located upwardly of said mobile body, at least one beam assembly for moving said platform up and down with respect to said mobile body, said beam assembly including a pair of middle beams pivotably interconnected by a common pivot so as to be foldable into an X shape, a pair of first beams telescopically supported in said middle beams, respectively, and a pair of second beams telescopically supported in said middle beams, respectively, a chain having one end connected to an end of each of said first beams and an opposite end connected to an end of each of said second beams, a sprocket wheel rotatably mounted in each of said middle beams, said chain being trained around said sprocket wheel in a substantially folded configuration, and a fluid pressure cylinder assembly having a cylinder fixedly mounted on said each first beam and a piston telescopically fitted in said cylinder and having an end fixedly mounted on each said middle beam, whereby said first and second beams can be moved in and out of said middle beam in opposite directions in response to operation of said fluid pressure cylinder assembly.

12. The elevating apparatus according to claim 11, wherein said each middle beam has a pair of parallel hollow guide portions, said first and second beams being telescopically disposed respectively in said parallel hollow guide portions.

13. The elevating apparatus according to claim 11, wherein each of said first and second beams has a pair of opposite longitudinal slots, each of said parallel hollow guide portions having a pair of opposite guide members extending longitudinally therein and slidably fitted in said slots, respectively, for guiding longitudinal movement of said first and second beams in said middle beam.

14. The elevating apparatus according to claim 11, including an initial lifting device mounted on said vehicle body and engageable with said common pivot for initially moving up the latter when said lift is to be raised.

* * * * *